US010151307B2

(12) United States Patent
Toennesmann et al.

(10) Patent No.: US 10,151,307 B2
(45) Date of Patent: Dec. 11, 2018

(54) MAGNET PUMP FOR AN AUXILIARY ASSEMBLY OF A VEHICLE, AND METHOD FOR CONTROLLING A MAGNET PUMP FOR AN AUXILIARY ASSEMBLY

(71) Applicant: PIERBURG GMBH, Neuss (DE)

(72) Inventors: Andres Toennesmann, Aachen (DE); Matthias Baden, Krefeld (DE); Costantino Brunetti, Froendenberg (DE); Michael Sanders, Kaarst (DE); Andreas Koester, Essen (DE)

(73) Assignee: PIERBURG GMBH, Neuss (DE)

( * ) Notice: Subject to any disclaimer, the term of this patent is extended or adjusted under 35 U.S.C. 154(b) by 261 days.

(21) Appl. No.: 15/034,181

(22) PCT Filed: Aug. 12, 2014

(86) PCT No.: PCT/EP2014/067247
§ 371 (c)(1),
(2) Date: May 4, 2016

(87) PCT Pub. No.: WO2015/067384
PCT Pub. Date: May 14, 2015

(65) Prior Publication Data

US 2016/0281695 A1 Sep. 29, 2016

(30) Foreign Application Priority Data

Nov. 8, 2013 (DE) ..... 10 2013 112 306

(51) Int. Cl.
*F04B 17/04* (2006.01)
*F04B 53/12* (2006.01)
*F04B 53/14* (2006.01)

(52) U.S. Cl.
CPC ..... *F04B 17/04* (2013.01); *F04B 17/044* (2013.01); *F04B 53/12* (2013.01); *F04B 53/14* (2013.01)

(58) Field of Classification Search
CPC .... F04B 7/0076; F04B 17/042; F04B 35/045; F04B 49/24; F04B 49/035; F04B 53/12;
(Continued)

(56) References Cited

U.S. PATENT DOCUMENTS 1,790,547 A * 1/1931 La Pointe ..... F04B 3/00 417/246
2,293,684 A 8/1942 Holthouse
(Continued)

FOREIGN PATENT DOCUMENTS

DE 25 03 241 A1 7/1976
DE 10 2007 016 856 A1 10/2008
(Continued)

*Primary Examiner* — Bryan Lettman
*Assistant Examiner* — Charles W Nichols
(74) *Attorney, Agent, or Firm* — Norman B. Thot

(57) ABSTRACT

A magnet pump for an auxiliary unit of a vehicle includes an inlet, an outlet, an electromagnet comprising an armature, a core, a coil and a yoke, a cylinder comprising an outlet opening, and an axial piston which moves in the cylinder. The axial piston includes first and second axial piston parts, a gap arranged between the first and second axial piston parts, and an axial through bore. A first non-return valve is biased between the first and second axial piston parts and against the axial piston. A second non-return valve is biased against the outlet opening of the cylinder. The first axial piston part is connected with/is integrally formed with the armature and is lifted off the second axial piston part. A fluidic connection exists between the inlet and the outlet via the gap when the first axial piston part is lifted off the second axial piston part.

16 Claims, 1 Drawing Sheet

(58) Field of Classification Search
CPC ..... F04B 2205/15; F04B 3/00; F04B 3/003; F04B 11/005; F04B 11/0075; F04B 11/0083; F04B 17/04; F04B 17/044; F04B 17/046; F04B 17/048; F04B 53/14; F04B 53/143; F04B 53/166; F04B 53/121; F04B 53/122; F04B 53/123; F04B 53/124; F04B 53/125; F04B 53/126; F04B 53/127; F04B 53/128; F04B 53/129
USPC ..... 417/260, 299, 307, 309; 92/109, 255, 92/256; 251/129.21
See application file for complete search history.

(56) References Cited

U.S. PATENT DOCUMENTS

| | | | | |
|---|---|---|---|---|
| 2,443,344 | A | 6/1948 | Ekleberry | |
| 4,150,924 | A | 4/1979 | Toyoda | |
| 4,274,407 | A | 6/1981 | Scarlett | |
| 7,093,778 | B1 * | 8/2006 | Hellmich | B05B 9/0413 239/585.1 |
| 9,624,922 | B2 * | 4/2017 | Holzel | F04B 49/22 |
| 2012/0230847 | A1 | 9/2012 | Lonski | |
| 2012/0251359 | A1 | 10/2012 | Neelakantan et al. | |

FOREIGN PATENT DOCUMENTS

| | | | |
|---|---|---|---|
| DE | 10 2008 058 046 | A1 | 5/2010 |
| DE | 10 2012 204 994 | A1 | 10/2012 |
| EP | 0 288 216 | A1 | 10/1988 |
| JP | 2000-45932 | A | 2/2000 |
| WO | WO 2011/029577 | A1 | 3/2011 |

* cited by examiner

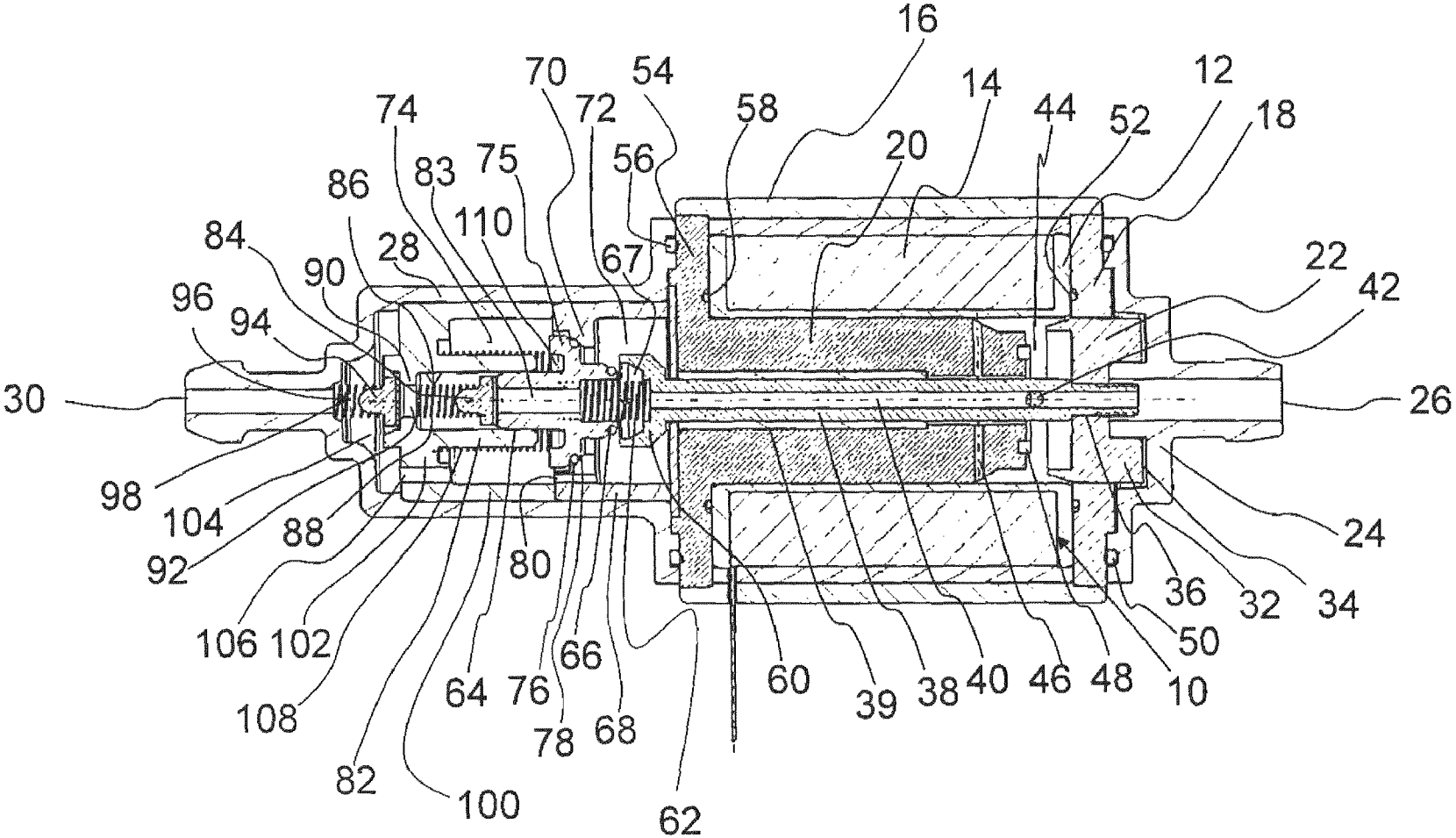
26
42
22
24
34
18
32
12
36
50
10
52
48
44
46
14
40
38
16
20
39
60
58
62
54
56
67
68
72
66
70
78
76
75
80
110
64
100
83
74
28
82
86
90
88
102
108
84
94
106
96
104
92
98
30

MAGNET PUMP FOR AN AUXILIARY ASSEMBLY OF A VEHICLE, AND METHOD FOR CONTROLLING A MAGNET PUMP FOR AN AUXILIARY ASSEMBLY

CROSS REFERENCE TO PRIOR APPLICATIONS

This application is a U.S. National Phase application under 35 U.S.C. § 371 of International Application No. PCT/EP2014/067247, filed on Aug. 12, 2014 and which claims benefit to German Patent Application No. 10 2013 112 306.6, filed on Nov. 8, 2013. The International Application was published in German on May 14, 2015 as WO 2015/067384 A1 under PCT Article 21(2).

FIELD

The present invention relates to a magnet pump for an auxiliary unit of a vehicle, having an inlet and an outlet, an electromagnet comprising a translatorily movable armature, a core, a coil, and a yoke, an axial piston which is adapted to be moved up and down in a cylinder, a first non-return valve which is biased against the axial piston, and a second non-return valve which is biased against an outlet opening of the cylinder. The present invention also relates to a method for controlling a magnet pump for an auxiliary unit of a motor vehicle, wherein an axial piston coupled with an armature of an electromagnet is moved up and down in a cylinder by alternately feeding current to the coil for the purpose of delivering a fluid from the inlet to the outlet.

BACKGROUND

Such magnet pumps are used, for example, to provide the pressure to hydraulically adjust a gate valve of a coolant pump which is driven via a pulley so as to thereby control volume flow.

In these pumps, an armature of the electromagnet and together therewith an axial piston comprising an axial through bore are moved up and down in a cylinder by alternately feeding current to the coil. The through bore is closed at its end facing the outlet by a non-return valve which is also arranged in the cylinder. The discharge movement is effected against another non-return valve which rests upon an outlet of the cylinder. The cylinder is filled when the valve is reset since its outlet is closed by the second non-return valve, and the first non-return valve is lifted off the axial piston due to the negative pressure produced in the cylinder by the return movement. The fluid is again moved out of the cylinder when current is again fed. Feeding of current and non-feeding of current or partial feeding of current to the coil of the electromagnet therefore results in intermittent pumping.

Such an electric fluid pump is described, for example, in EP 0 288 216 A1. To prevent an undesired braking of the piston and/or the armature by the axial movement of the armature and the positive and negative pressures thus produced at the opposite axial ends of the armature, the two spaces in front of and behind the armature are connected with each other via axially extending grooves or corresponding deepened portions of the guide or the armature so that a pressure compensation can take place.

Another magnet pump or oscillation pump is described in WO 2011/029577 A1. In this pump, the axial piston is not fixedly connected with the armature, but is merely pressed against the armature via a compression spring. The unit of piston and armature is therefore inexpensive to produce since an offset of the guides can be compensated.

These conventional magnet pumps have the disadvantage, however, of not providing a fail-safe function. For example, if used to adjust an adjusting ring of a coolant pump, this means that in the case of a coolant pump closed by the adjusting ring and failure of the magnet pump that the pressure in the chamber can only be reduced very slowly through leakages via the magnet pump, or that additional drain valves must be used. When using a hydraulically controllable mechanical coolant pump, overheating of the internal combustion engine with the corresponding subsequent damage may otherwise, for example, occur.

SUMMARY

An aspect of the present invention is to provide a magnet pump which can provide a rapid return flow via the pump in the case of failure of the electromagnet, which, in the case of the coolant pump, leads to a relief of the adjusting ring and thus to a maximum delivery rate of the coolant pump. A further aspect of the present invention is avoid using additional driven valves to reduce the pressure.

In an embodiment, the present invention provides a magnet pump for an auxiliary unit of a vehicle which includes an inlet, an outlet, an electromagnet comprising a translatorily movable armature, a core, a coil and a yoke, a cylinder comprising an outlet opening, and an axial piston configured to be moved up and down in the cylinder. The axial piston includes a first axial piston part, a second axial piston part, a gap arranged between the first axial piston part and the second axial piston part, and an axial through bore. A first non-return valve is biased between the first axial piston part and the second axial piston part, and against the axial piston. A second non-return valve is biased against the outlet opening of the cylinder. The first axial piston part is connected with or is integrally formed with the armature. The first axial piston part is configured to be lifted off the second axial piston part. A fluidic connection exists between the inlet and the outlet via the gap when the first axial piston part is lifted off the second axial piston part.

BRIEF DESCRIPTION OF THE DRAWING

The present invention is described in greater detail below on the basis of embodiments and of the drawing in which:

FIG. 1 shows a sectional side view of a magnet pump according to the present invention.

DETAILED DESCRIPTION

Due to the fact that the axial piston has a two-part configuration and comprises an axial through bore, wherein the first axial piston part is connected with the armature or is integrally formed with the armature and is adapted to be lifted off the second axial piston part, wherein in the lifted-off state the fluidic connection between the inlet and the outlet is established via a gap between the two axial piston parts, a flow through the pump and in particular a return flow from a pressure space to be filled via the pump pressure is possible without the use of an additional driven valve. A fail-safe position is thus created when using a coolant pump controlled, for example, via a slider. This is also made possible by a method wherein, in the case where no current is fed to the coil, the armature or the axial piston connected or integrally formed with the armature is pressed in this position of the armature into its fully retracted position in which a gap is permanently cleared by the armature, via which gap a fluidic connection is established between the inlet and the outlet.

In an embodiment of the present invention, a compression spring can, for example, be arranged between the first axial piston part and the second piston part, which compression spring, in the case of a failure of the electromagnet, provides that the armature is pressed into its fully retracted position and, on the other hand, dampens the stopper of the two axial piston parts during movement of the armature out of this position.

In an embodiment of the present invention, the second axial piston part can, for example, rest upon the stopper due to the compression force of a second compression spring, which second compression spring is stronger than the first compression spring, when the armature is fully reset, so that, in the operating positions of the armature during pump operation, the armature rests upon the first axial piston part. It is thus provided that, during movement out of the fully retracted position of the armature, first the gap between the first axial piston part and the second axial piston part is closed and, subsequently, the axial piston as a unit is displaced during the actual pump movement.

In an embodiment of the present invention, the stopper can, for example, be defined at a first insert housing part. The production of the overall outlet housing is thereby simplified.

The first non-return valve is biased against the second axial piston part via a first spring and is moved together with the second piston part towards the outlet, and the second non-return valve is biased against the outlet opening of the cylinder via a second spring. Buildup of a sufficient pressure during the discharge movement is thus provided and a subsequent filling of the cylinder during pump operation is allowed.

In an embodiment of the present invention, the first axial piston part can, for example, be connected with the armature via a bore in the armature. A common movement is thereby provided. Setup and assembly remain simple since fastening can be effected via screws or by pressing, and merely the first axial piston part must be guided.

In an embodiment of the present invention, the effective diameter of the second axial piston part can, for example, be larger than the effective diameter of the first axial piston part. This provides a filling of the piston space with a portion of the delivered fluid during discharge of the fluid so that pressure differences inside the pump chambers are compensated.

In an embodiment of the present invention, the inlet and the outlet can, for example, be arranged at axially opposite ends of the magnet pump. The armature is thereby arranged at the inlet side, and the non-return valves and the second axial piston part are arranged at the outlet side. This results in an axial flow through the pump with small pumping losses and the possibility to produce hydraulic damping chambers.

In an embodiment of the present invention, in an outlet housing, a second insert housing is arranged where the cylinder is defined, in which the second axial piston part is guided and the first non-return valve is arranged, wherein the second non-return valve is loaded against an outlet opening of the cylinder, which outlet opening leads to an outlet space that ends in the outlet. This configuration simplifies the production and delimitation of the individual hydraulic chambers in the outlet housing.

In an embodiment of the present invention, a continuous fluidic connection can, for example, exist between a piston space, into which the first axial piston part projects, an intermediate space surrounding the cylinder, and the outlet space. This results in relatively small required actuating forces of the electromagnet since a pressure compensation between the chambers can be provided. This also allows the fluidic connection between the inlet and the outlet to be established.

The fluidic connection is established via openings in the second insert housing part and in the first insert housing part where the stopper is defined, which is arranged between the intermediate space and the piston space. The hydraulic chambers and their interconnections, the stopper, and the guide of the second axial piston part can thus be produced in a simple manner.

In an embodiment of the present invention, the spring of the first non-return valve can, for example, be configured so that the first non-return valve delayedly follows the second axial piston part during movement of the second axial piston towards the inlet. Adequate filling of the cylinder for fluid delivery is thereby provided.

To reduce dampening of the movement of the armature and/or the axial piston by compression of the fluid in the space between the armature and the core, a transverse bore is defined in the first axial piston part and at the core in the inlet-side area.

Collisions between the moving parts or between the movable parts and their stoppers are also prevented by arranging elastic damping elements at the second axial piston part in the area of the stopper and/or in the area of resting upon the first axial piston part and/or between the armature and the core.

In an embodiment of the present invention, an annular recess facing the insert housing part can, for example, be defined at the second axial piston part, into which recess an axial end of the cylinder is inserted when the armature is fully adjusted towards the outlet. This recess serves as a hydraulic damping chamber during the movement of the axial piston towards the outlet, which damping space prevents the second axial piston part from colliding with the cylinder wall.

In the same manner, a collision during movement of the armature towards the inlet is prevented in that, at the inlet side, an annular recess is defined at an inlet housing of the magnet pump, into which recess a corresponding annular projection of the armature facing the inlet is inserted when the armature is fully reset. The annular recess here too serves as a hydraulic damping chamber.

A magnet pump is thus provided which provides a fail-safe position in the case of failure of the electromagnet or a failure to feed current to the electromagnet, in which fail-safe position a free flow through the pump in both directions is possible. An additional shutoff valve is thus not required. This position can of course be approached for the purpose of opening the connection. Collisions due to the movement of the axial piston and/or the armature are reliably avoided. An undesired hydraulic counterpressure which would require an increased magnetic force is at the same time prevented.

An exemplary embodiment of a magnet pump according to the present invention is illustrated in the FIGURE and is hereinafter described.

The magnet pump illustrated in FIG. 1 comprises an electromagnet 10 which is composed of a coil 14 wound to a coil carrier 12, a yoke 16, a return ring 18, as well as a core 20, and a movable armature 22. When current is fed to the coil 14, the magnetic forces produced pull the armature 22 towards the core 20 in a known manner.

The magnet pump comprises an inlet housing 24 in which an inlet 26 for a fluid is defined, and an outlet housing 28 in which an outlet 30 for the fluid is defined and which is arranged at the side of the electromagnet 10 axially opposite to the inlet housing 24. The armature 22 arranged adjacent to the inlet housing 24 comprises an annular projection 32 at its axial end facing the inlet housing 24, which annular projection 32 extends into a correspondingly shaped annular recess 34 in the inlet housing 24 in the illustrated position of the armature 22. The armature 22 also comprises a central axial bore 36 in which a first axial piston part 38 is fastened that is arranged axially opposite to the inlet 26.

The first axial piston part 38 is supported in a sliding bushing 39 which is fastened inside the core 20, and which extends from the inlet housing 24 to the outlet housing 28. The first axial piston part 38 comprises an axial through bore 40 as well as at least one transverse bore 42 via which the inlet 26 of the magnet pump is in fluidic connection with a space 44 between the armature 22 and the core 20. Another connection into this space 44 is established via a transverse bore 46 in the core 20, which transverse bore 46 is arranged in an area in which the core 20 has a reduced diameter as compared with the surrounding coil carrier 12. An elastic damping element 48 is additionally fastened to the core 20 at its surface facing the armature 22. The inlet housing 24 is fastened to the return ring 18 with a sealing ring 50 being interposed, and at its axially opposed side, another sealing ring 52 is arranged which seals a gap between the coil carrier 12 and the return ring 18 so that no fluid can reach the coil 14. At the axially opposite side of the electromagnet 10, the core 20 comprises a radial extension 54 where further sealing rings 56, 58 are arranged at both axial sides which seal the gap towards the outlet housing 28 fastened to the core 20 and the gap towards the coil carrier 12.

At the end facing the outlet 30, the first axial piston part 38 comprises a wrench-shaped extension 60 upon which a biased first compression spring 62 rests whose opposite axial end rests upon a second axial piston part 64 whose end facing the first axial piston part 38 is configured so that it corresponds to the extension 60 of the first axial piston part 38 and which is provided with an elastic damping element 66. A gap 67 exists in this position between the first axial piston part 38 and the second axial piston part 64. In the outlet housing 28, a first insert housing part 68 having a radial reduced portion 70 is arranged via which the outlet housing 28 is divided into a piston space 72 and an intermediate space 74. In the position illustrated in FIG. 1, a radial extension surface 75 of the second axial piston part 64 rests upon the radial reduced portion 70, which acts as a stopper 76 for the second axial piston part 64. The effective diameter of the first axial piston part 38 is accordingly smaller than that of the second axial piston part 64. Another elastic damping element 78 is arranged in the area of the stopper 76 at the extension surface 75. Via an opening 80 defined in the first insert housing part 68, a continuous fluidic connection of the piston space 72, into which the first axial piston part 38 extends, and the intermediate space 74 exists.

At the end facing the outlet 30, the second axial piston part 64 is defined as a hollow cylinder and extends into a cylinder 82 in which the part of the second axial piston part 64 configured as a hollow cylinder is guided and which is arranged radially inside the intermediate space 74. A closing body 84 of a first non-return valve 86 controlling the axial through bore 83 of the second axial piston part 64 is biased against the open end of the second axial piston part 64 facing the outlet 30 via a first spring 88 of the first non-return valve 86, the opposite end of the first spring 88 resting upon a reduced portion 90 axially delimiting the cylinder 82, the reduced portion 98 surrounding an outlet opening 92 of the cylinder 82.

A closing body 94 of a second non-return valve 96 controlling the outlet opening 92 is biased against this reduced portion 90 via a spring 98, the opposite end of which rests upon a surface surrounding the outlet 30 of the outlet housing 28. In the outlet housing 28, a second insert housing part 100 is arranged which defines the cylinder 82 and whose axial delimiting wall 102 facing the outlet 30 separates the intermediate space 74 from an outlet space 104 which leads to the outlet 30 and in which the second non-return valve 96 is arranged. In this delimiting wall 102, at least one opening 106 is defined via which a continuous fluidic connection between the intermediate space 74 and the outlet space 104 exists.

A second compression spring 108 is also located in the intermediate space 74, which is stronger than the first compression spring 62 and which surrounds the cylinder 82. The first axial end of this second compression spring 108 bears upon the intermediate wall 102, and the other axial end bears upon the extension surface 75 of the second axial piston part 64 so that the latter is loaded towards the first axial piston part 38.

At this end of the second axial piston part another annular recess extending in the axial direction is defined which is configured so that it corresponds to the axial end of the cylinder 82.

No current is fed to the coil 14 in the shown position of the armature 22. According to the present invention, the inlet 26 is fluidically connected with the outlet 30 via axial through bore 40, gap 67, piston space 72, openings 80, 106 of the insert housing parts 68, 100, as well as outlet space 104. This is realized in that the second compression spring 108 presses the second axial piston part 64 towards the first axial piston part 38, and the first compression spring presses the first axial piston part 38 with the armature 22 towards the inlet 26 so that the gap 67 between the two axial piston parts 38, 64 is created which is closed in the other positions of the armature 22 and/or in the other current-feed states of the coil 14. If such a pump is used to adjust an adjusting ring of a coolant pump, the pressure from the space can be reduced to adjust the ring during shutoff or failure to feed current to the pump so that a maximum delivery of the coolant pump is provided by resetting the adjusting ring.

The electromagnet 10 of the magnet pump is switched between a partial current feed and a full current feed to the coil 14 during operation.

The amount and the duration of the partial current feed are selected so that the force of the first compression spring 62 is overcome so that the first axial piston part 38 rests upon the second axial piston part 64, and thus the gap 67 between the two axial piston parts 38, 64 is closed via the damping element 66 so that the two axial piston parts 38, 64 move as a unit during operation. The second (stronger) compression spring 108 is not compressed during partial current feed since its force is larger than that of the electromagnet 10 during partial current feed. The second axial piston part 64 hence remains at the stopper 76. In this position, the annular projection 32 just extends into the annular recess 34 in the inlet housing 24 so that the intermediate space 74 is merely connected with the remaining fluid-filled space via gaps between the armature 22 and the coil carrier 12 and/or the armature 22 and the inlet housing 24. This results in a strong damping of the movement when the armature 22 moves towards the inlet 26 due to the pressure being only slowly reduced via the gaps in this space.

If the current feed is subsequently switched to full current feed, the force acting upon the armature 22 towards the outlet 30 is larger than the sum of the counteracting forces, namely the spring forces of the compression springs 62, 108 and the possibly existing hydraulic forces acting upon the components. The axial piston parts 38, 64 is thus moved as a unit towards the outlet 30. With the aid of the axial piston parts 38, 64, the first non-return valve 86 in the cylinder 82 is moved towards the outlet 30 so that a pressure builds up in the cylinder 82 which finally results in the second non-return valve 96 opening against its spring force and fluid flowing from the cylinder 82 into the outlet space 104. A portion of the fluid flows out of the outlet space 104 via the outlet 30, while another portion of the fluid flows into the intermediate space 74 and the piston space 72 via the openings 80, 106 since the fluid volume in the piston space 72 is reduced only by a fraction of the discharged fluid volume during extension of the piston part 38.

If the current feed is subsequently switched back to partial current feed, the axial piston parts 38, 64 moves as a unit towards the inlet 26. Due to its inertia and the negative pressure produced during this movement in the cylinder 82, now closed by the second non-return valve 96, the first non-return valve 86 follows the axial piston parts 38, 64 with a considerable delay since its spring force does not suffice for allowing it to remain rested upon the axial piston parts 38, 64. During this movement, this negative pressure causes fluid to be taken into the cylinder 82 via the axial through bores 40, 83, that is, it flows into the cylinder 82 via the gap between the first non-return valve 86 and the axial piston parts 38, 64. In the piston space 72, this movement produces a positive pressure which causes the fluid to be pressed out of the piston space 72 through the openings 80, 106 and the intermediate space 74 and the outlet space 104 to the outlet 30 so that another delivery takes place. Due to the resulting pressure compensation, the first non-return valve 86 again rests upon the axial piston parts 38, 64 so that the initial position is again reached. The force required for this movement is supplied by the second compression spring 108. This process is repeated as often as required for the necessary volume flow.

When no current is fed, the two axial piston parts 38, 64 are again separated since the second compression spring 108 presses the second axial piston part 64 against the stopper 76 and the first compression spring 62 presses the first axial piston part 38 away from the second axial piston part 64. The free flow path between the inlet 26 and the outlet 30, which has already been described, accordingly exists.

All movements taking place due to a change in the current feed are dampened. On the one hand, there exists a dampening of the stoppers between the armature 22 and the core 20, the first axial piston part 38 and the second axial piston part 64 as well as the second axial piston part 64 and the stopper 76 caused by the elastic damping elements 48, 66, 78, and on the other hand caused by the hydraulic damping chamber between the inlet housing 24 and the armature 22 due to the annular projection 32 corresponding with the annular recess 34.

Another hydraulic damping chamber becomes effective during the movement of the second axial piston part 64 towards the outlet 30. The outer circumference of the radial extension surface 75 of the second axial piston part 64 is bent towards the cylinder 82 so that an annular recess 110 is created between the part configured as a hollow cylinder, which can be moved into the cylinder, and this surface. The end of the cylinder 82 facing the inlet 26 engages with the recess during the movement of the axial piston parts 38, 64 towards the outlet 30 so that the fluid present in the annular recess 110 can merely escape via gaps, thus dampening the movement.

An undesired damping effect of the armature movement is also prevented by the transverse bore 42 in the first axial piston part 38 as well as the traverse bore 46 in the core 20 due to compression or formation of a negative pressure in the space 44.

The magnet pump according to the present invention experiences a very low wear and offers a simple and rapid pressure compensation between the inlet and the outlet. At the same time, this function of resetting of the armature 22 can also be used as a fail-safe function when the magnet pump is used accordingly. A separate valve is thus not required.

It should be appreciated that the scope of protection of the main claim is not limited to the described exemplary embodiment. The scope of protection of the method claim is further not limited to the subject matter of the apparatus claims since a different configuration for realizing a gap establishing the fluidic connection is also conceivable.

What is claimed is:

1. A magnet pump for an auxiliary unit of a vehicle, the magnet pump comprising:
- an inlet;
- an outlet;
- an electromagnet comprising an armature which is configured to be translatorily movable, a core, a coil, and a yoke;
- a cylinder comprising an outlet opening;
- an axial piston configured to be moved towards the outlet and away from the outlet in the cylinder, the axial piston comprising,
  - a first axial piston part,
  - a second axial piston part,
  - a gap arranged between the first axial piston part and the second axial piston part, and
  - an axial through bore;
- a first non-return valve biased against the second axial piston part of the axial piston; and
- a second non-return valve biased against the outlet opening of the cylinder,
- wherein,
  - the first axial piston part is connected with or is integrally formed with the armature,
  - the first axial piston part is configured to be lifted off the second axial piston part, and
  - a fluidic connection exists between the inlet and the outlet via the gap, a first opening bypassing the first non-return valve and a second opening bypassing the second non-return valve, when the first axial piston part is lifted off the second axial piston part.

2. The magnet pump as recited in claim 1, further comprising a first compression spring arranged between the first axial piston part and the second axial piston part.

3. The magnet pump as recited in claim 2, further comprising:
- a stopper; and
- a second compression spring comprising a compression force,
- wherein,
- the first compression spring comprises a compression force,
- the compression force of the second compression spring is larger than the compression force of the first compression spring, and the second axial piston part is configured to rest upon the stopper due to the compression force of the second compression spring when the armature is completely reset, and to rest upon the first axial piston part in an operating position of the armature during a pump operation.

4. The magnet pump as recited in claim 3, further comprising:

a first inset housing part, wherein, the stopper is formed at the first insert housing part.

5. The magnet pump as recited in claim 1, further comprising:

a first spring; and a second spring, wherein, the first non-return valve is biased against the second axial piston part via the first spring, and the second non-return valve is biased against the outlet opening of the cylinder via the second spring.

6. The magnet pump as recited in claim 1, wherein, the armature comprises a bore, and the first axial piston part is connected with the armature via the bore.

7. The magnet pump as recited in claim 1, wherein, the first axial piston part comprises an effective diameter, the second axial piston part comprises an effective diameter, and the effective diameter of the second axial piston part is larger than the effective diameter of the first axial piston part.

8. The magnet pump as recited in claim 1, wherein, the inlet and the outlet are arranged at axially opposite ends of the magnet pump, the armature is arranged at a side of the inlet, and the first non-return valve, the second non-return valve, and the second axial piston part are each arranged at a side of the outlet.

9. The magnet pump as recited in claim 4, further comprising:

an outlet housing configured to form the outlet;

an outlet space configured to end in the outlet; and a second insert housing part arranged in the outlet housing, wherein, the cylinder is formed in the second insert housing part, the second axial piston part is guided in and the second non-return valve is arranged in cylinder, the second non-return valve is loaded against the outlet opening of the cylinder, the outlet opening leads into the outlet space, and the outlet space leads to the outlet.

10. The magnet pump as recited in claim 9, further comprising:

a piston space configured to have the first axial piston part extend therein; and an intermediate space configured to surround the cylinder and the outlet space, wherein, a continuous fluidic connection exists between the piston space and the intermediate space.

11. The magnet pump as recited in claim 10, wherein, the first insert housing part comprises a first opening, the second insert housing part comprises a second opening, the stopper is arranged between the intermediate space and the piston space, and the continuous fluidic connection is established via the first opening and the second opening.

12. The magnet pump as recited in claim 5, wherein, the first spring is configured so that the first non-return valve delayedly follows the second axial piston part during its movement towards the inlet.

13. The magnet pump as recited in claim 1, further comprising:

a first transverse bore arranged at an inlet-side area in the first axial piston part; and a second transverse bore arranged at the inlet-side area at the core.

14. The magnet pump as recited in claim 1, further comprising:

an elastic damping element arranged at at least one of, the second axial piston part in an area of the stopper, in an area which the first axial piston part is rested upon, and between the armature and the core.

15. The magnet pump as recited in claim 9, further comprising:

a first annular recess facing the second insert housing part formed at the second axial piston part, wherein, an axial end of the cylinder is inserted into the first annular recess when the armature is fully adjusted towards the outlet.

16. The magnet pump as recited in claim 15, further comprising an inlet housing; and a second annular recess arranged at a side of the inlet, the second annular recess being defined by the inlet housing, wherein, the armature further comprises an annular projection, and the annular projection of the armature facing the inlet is inserted into the second annular recess when the armature is fully reset.

* * * * *